United States Patent [19]

Simpson

[11] Patent Number: 4,499,802

[45] Date of Patent: Feb. 19, 1985

[54] ROTARY CUTTING DIE WITH SCRAP EJECTION

[75] Inventor: Jack R. Simpson, Toledo, Ohio

[73] Assignee: Container Graphics Corporation, Toledo, Ohio

[21] Appl. No.: 426,866

[22] Filed: Sep. 29, 1982

[51] Int. Cl.[3] ..... B26D 7/18

[52] U.S. Cl. ..... 83/117; 83/139

[58] Field of Search ..... 83/117, 116, 118, 123, 83/138–140, 124–128, 669–670; 493/82–83, 472, 342, 373; 76/107 R

[56] References Cited

U.S. PATENT DOCUMENTS

| | | | |
|---|---|---|---|
| 3,167,985 | 2/1965 | Madsen | 83/139 |
| 3,618,438 | 11/1971 | Simpson | 83/669 |
| 3,805,657 | 4/1974 | Simpson | 83/669 |
| 3,946,627 | 3/1976 | Hofmann | 83/117 |
| 3,964,655 | 6/1976 | Kotaro | 493/373 |
| 4,305,716 | 12/1981 | Nickum | 493/342 |
| 4,306,476 | 12/1981 | Saunders et al. | 83/117 |

FOREIGN PATENT DOCUMENTS

| | | | |
|---|---|---|---|
| 2024081 | 1/1980 | United Kingdom | 83/117 |

*Primary Examiner*—James M. Meister
*Assistant Examiner*—John L. Knoble
*Attorney, Agent, or Firm*—Allen D. Gutchess, Jr.

[57] ABSTRACT

A cutting die is provided with scrap ejection provisions for removing scrap from the die. The ejection provisions are particularly effective for ejecting elongate scrap from elongate openings such as slots which are formed in carton blanks and the like, the blanks being produced from sheet material, such as corrugated board. The ejection system includes resilient ejection member located between two parallel cutting rules, which members eject or push out the scrap from between the rules in an asymmetrical manner, exerting more force along one edge of the scrap than the other. This causes the scrap to twist and be more easily ejected. An additional ejection member is located outside one of the cutting rules to cause a portion of the blank to deflect to further aid in the scrap ejection.

16 Claims, 7 Drawing Figures

ROTARY CUTTING DIE WITH SCRAP EJECTION

This invention relates to a cutting die with improved ejection provisions for ejecting scrap from the die and stripping scrap free from the finished corrugated product.

A cutting die is commonly used for producing a container or carton blank from sheet material, such as corrugated board. A common type of opening is a slot which extends inwardly from an edge of the carton blank and forms flaps in the blank which are used to produce a bottom or top of the carton. The slot is formed by cutting rules and the severed piece of scrap must be ejected after the cutting operation or the scrap will be wedged in the recess or cavity formed between the cutting rules and the die will be inoperative after several carton blanks are formed.

Earlier ejection members employed between the cutting rules were in the form of resilient rubber strips. These strips completely filled the cavity or recess formed between the cutting rules and while the rubber is resilient, it is not compressible. With no place for the rubber to be displaced, the ejection strip would sometimes bend outwardly the cutting rules or deform the plastic back-up cylinder used with the cutting die cylinder to prevent the cutting rule from fully contacting the back-up cylinder and producing proper cuts through the corrugated board. The rubber strip would also tend to break down prematurely due to the repeated mechanical action it endures.

More recently, the thickness of the die plates employed in the cutting rule dies were reduced from five-eighths inch to one-half inch, resulting in a deeper cavity between the cutting rules, which remain at the same height. Ejection strips of high density, closed-cell foam rubber were employed more successfully in such dies. However, the closed cell foam was expensive and hard to make consistently or uniformly with the same degree of hardness. Also, two pieces of such strips with the same durometer reading could have a different "feel" of softness. Functionally, however, the high density, closed-cell rubber strips would crush the slot scrap sufficiently to cause it to be ejected reasonably well where wider slots were formed in a blank.

Ejection strips have also been employed as shown in U.S. Pat. No. 3,827,322 issued on Aug. 6, 1974, and assigned to the assignee of the present application. These strips had a taper from a wider bottom surface or base to an upper, narrower surface, which provided space in the cavity between the cutting rules for expansion or movement. Such strips were commonly made of gum rubber which had the problems mentioned above as well as not being capable of taking heat well and, consequently, breaking down. Also, such strips, as all ejection strips heretofore employed, have been less than fully effective in ejecting and stripping slot scrap, particularly where narrow slots were concerned.

All ejection strips heretofore have ejected or pushed out the slot scrap uniformly or at least symmetrically with respect to a center line extending between the cutting rules. Particularly with narrower slots formed in rotary cutting dies, the slot scrap would tend to stick in the slot, even though the scrap was crushed to a considerable degree. Hand stripping of the scrap was often resorted to, which was extremely time consuming, and added substantially to the cost of the carton blanks or other products. Other means have also been employed or attempted to form narrow slots in carton blanks or the like. For example, in bottle cartons where bottles are separated by partitions which must be slotted in order to assemble them in interesting relatonship among the bottles in the carton, slots were formed by large circular saws which cut kerfs in a number of blanks stacked together. This required considerable power and also huge exhaust fans to remove the cardboard dust or particles. While this was less expensive than hand stripping the slot scrap, it nevertheless had obvious disadvantages and high costs.

The present invention provides a cutting die with improved scrap ejecting and stripping provisions, particularly for slot scrap of carton blanks and other products. The provisions cause the scrap to be ejected asymmetrically from the slot in the blank, causing the scrap to twist. This is accomplished by placing a stronger force along an edge of the scrap near one of the cutting rules than near the other cutting rule and applying the force longer as the scrap moves outwardly. The ejection can be more effective by also deflecting or pushing outwardly the portion of the carton blank immediately outside the other cutting rule.

The asymmetrical force can be accomplished by using two ejection strips or members between the cutting rules. Along the inside surface of a first one of the cutting rules, the ejection member or strip is made of more dense material and is higher, extending to or above the cutting edge of the adjacent, first cutting rule. Another ejection member or strip is positioned between the first ejection member and the second cutting rule, being of less dense material and preferably lower, not extending above the cutting edge of the second cutting rule. The first ejection strip pushes the slot scrap with more force and further than the second ejection strip, with the result that the scrap assumes a slanted or twisted position as it is pushed out of the slot in the blank.

In a preferred form, a third ejection member or strip, which can be of relatively low density material, is also positioned along the outside of the second cutting rule. This momentarily deflects the carton blank adjacent one side of the slot, moving it out of the plane of the carton blank on the opposite side of the slot. This action momentarily displaces the opposite walls of the slot being formed to further separate those edges from the edges of the slot scrap, thereby further facilitating the ejection of the scrap.

It is, therefore, a principal object of the invention to provide a cutting die with improved ejection provisions for elongate scrap cut from blanks.

Another object of the invention is to provide an improved means and method of ejecting elongate scrap from a carton blank or the like by placing a greater amount of force for a longer time along one longitudinal edge of the scrap than along the opposite edge, as the scrap is being cut from the blank.

A further object of the invention is to provide an improved means and method of ejecting elongate scrap from a blank by producing an asymmetrical force on the scrap and by deflecting a portion of the blank from which the slot is formed along the edge of the elongate scrap to which the lesser ejecting force is applied.

Still another object of the invention is to provide a cutting die with an improved ejection means for ejecting scrap from narrow slots formed by parallel cutting rules with the ejection means having two ejection members between the cutting rules which apply forces of different magnitudes to the scrap and an additional ejection member adjacent the outside of the cutting rule which is adjacent the ejection member applying the lesser force to the scrap.

Many other objects and advantages of the invention will be apparent from the following detailed description of preferred embodiments thereof, reference being made to the accompanying drawings, in which.

Figure 1:
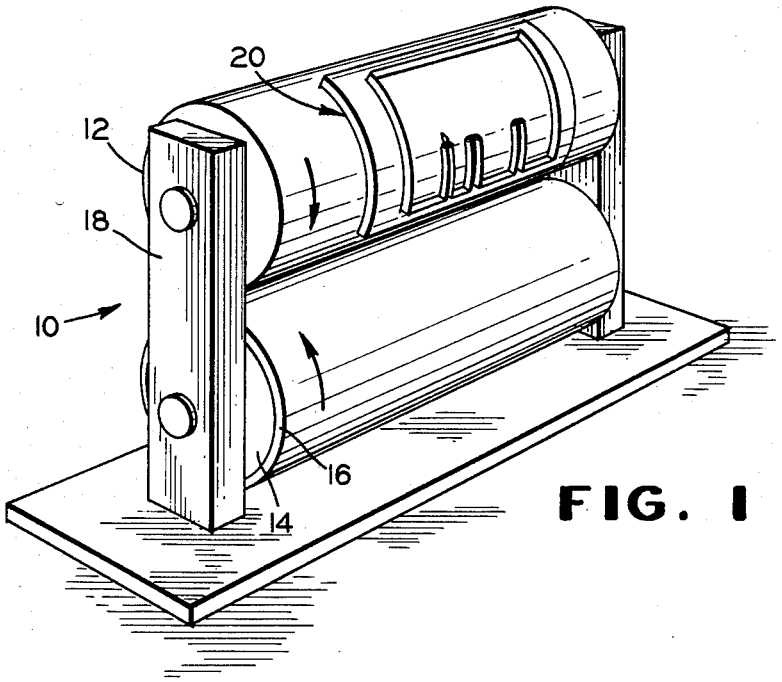
FIG. 1 is a schematic view in perspective of a rotary die machine embodying the invention.

Referring to the drawings and particularly to FIG. 1, a rotary die machine 10 includes an upper die cylinder 12 and a lower back-up cylinder 14. A resilient plastic layer 16 is mounted on the back-up cylinder 14 and the two cylinders are rotably mounted in a suitable frame or stand 18. The cylinders can be adjusted by suitable means so that the distance between them can be changed, as is known in the art. In operation, the cylinders 12 and 14 are rotated in the directions of the arrows by suitable drive means (not shown). Corrugated board or other sheet material is fed between the cylinders where it is engaged by a rotary cutting die 20 and shaped or formed into a blank from which cartons or other products can be produced or fabricated.

The rotary cutting die 20 basically includes a die plate or board 22 in which are mounted steel cutting rules, creasing rules, and/or perforating rules. The die board 22 is usually made of high quality plywood formed in the arcuate shape shown, but it can also be made of plastic material. Layout lines for the rules can be made on the surface of the die board 22 with saw cuts then made on these lines and the appropriate rules inserted in the kerfs, being backed up by the die cylinder 12.

Figure 2:
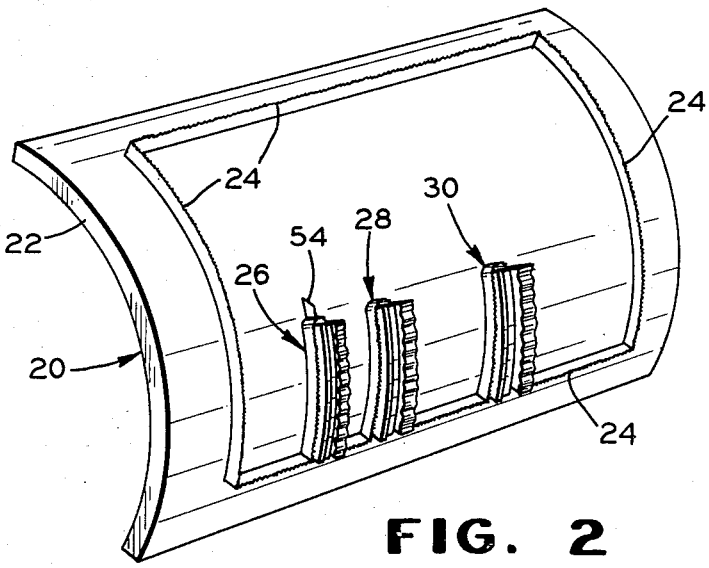
FIG. 2 is an enlarged view in perspective of a rotary steel rule cutting die shown in FIG. 1.
Figure 4:
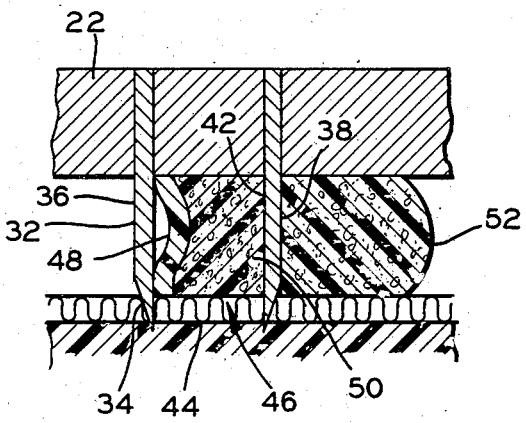
FIG. 4 is a further enlarged view in cross section taken along the line 4—4 of FIG. 3.
Figure 5:
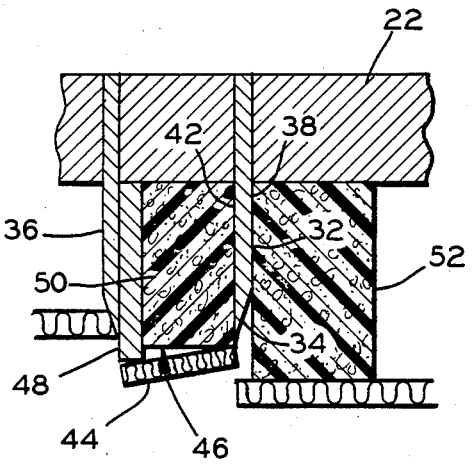
FIG. 5 is a view in cross section similar to FIG. 4 but taken along the line 5—5 of FIG. 3.

As shown in FIG. 2, steel cutting rules 24 cut a corrugated board or sheet 25 (FIG. 3) into a rectangular shape of predetermined size. For purposes of illustration, three slots, in this instance, are also cut in the corrugated board blank by three U-shaped cutting rules 26, 28, and 30. As shown in FIGS. 4 and 5, for example, the cutting rules have main strips 32 terminating in serrated cutting edges 34 at the upper or outer edges thereof. The cutting rules usually have single bevels forming the cutting edges but double bevels can also be employed with the cutting edges being centered relative to the thickness of the cutting rules.

The cutting rules 26, 28, and 30 have straight, usually parallel portions 36 and 38 joined by an end web 40. The space between the straight portions 36 and 38 of the cutting rule determine the width of the slot, which can be as narrow as one-eighth inch. Heretofore, such narrow slots have seldom been designed into blanks formed from corrugated board and similar sheet material because the slot scrap would tend to stick in the slots, requiring hand stripping of the scrap, which was time consuming and costly.

The cutting rules 26–30 form cavities or recesses 42 with the surface of the die plate 22 therebetween. The slot scrap 44 ordinarily would be forced into the recess but is ejected therefrom and, hopefully, is separated from the carton blank in which the slot is formed. Heretofore, ejection strips have been employed in the recesses 42 to eject or push out the slot scrap. However, such ejection strips have forced the scrap uniformly outwardly or at least symmetrically with respect to a central line extending between the parallel cutting rule portions. Such slot scrap would tend to stick in the formed slot, between the edges thereof, even though the scrap was compressed considerably by the ejection strip.

The present invention provides improved scrap ejection provisions for the cutting rules 26–30 forming the slots in the carton blank. The ejection provisions cause the scrap to be ejected asymmetrically to cause the scrap to twist. This is accomplished by placing a stronger force along an edge of the scrap near one of the cutting rule portions than near the other one and continuing to apply the force longer as the scrap moves outwardly. The ejection of the scrap is even more effective by also deflecting or pushing outwardly the portion of the carton blank immediately outside the othe cutting rule, by use of another ejection strip.

As shown in FIGS. 4 and 5 in particular, resilient ejecting means indicated at 46 is located between the parallel cutting rule portions 36 and 38. The ejecting means 46, in this instance, includes an ejection member or strip 48 located adjacent the cutting rule portion 36 and an ejection member or strip 50 located adjacent the cutting rule portion 38, between that portion and the ejection member 48. The ejection member 48 is made of more dense material and is higher than the ejection member 50. The ejection member 48 is resilient but incompressible, preferably being made of urethane with a durometer of 70–90 and preferably 80, as determined on a shore A-type of hardness tester. The member 48 preferably extends above the cutting edge 34 of the cutting rule and has a thickness from about one-sixteenth inch to about one-eighth inch. For example, with a one-eighth inch slot the thickness of a member 48 can be one-sixteenth inch, but preferably does not exceed one-eigth inch for slots one-quarter inch wide or wider. The ejection members 48 and 50 also extend substantially the length of the cutting rule portions 36 and 38.

The ejection member 50 preferably is of closed-cell foam rubber which is both resilient and compressible so as to accommodate the ejection member 48 if it is pushed inwardly at the nip of the cylinders 12 and 14 during operation thereof, as shown in FIG. 4. The member 50 has a durometer from 45 to 65 and preferably 55 on the shore 00-type of hardness tester. The member 50 has a thickness which fills the recess 42 from the member 48 to the opposite cutting rule portion and has a height which preferably does not exceed the height of the edges of the cutting rule portions, and is less than the height of the ejection member 48.

An outside ejection member or strip 52 is located on the side of the cutting rule portion 38 opposite the ejection member 50 and preferably has a height exceeding the height of both the ejection members 48 and 50. The ejection member 52 is preferably also of closed-cell foam rubber and has a hardness or density preferably equal to or greater than that of the ejection member 50. The member 52 extends substantially the length of the cutting rule portion 38.

The ejection members 48 and 50 can be held in the recess 42 by friction although adhesive can also be employed, if desired. The outer ejection member 52 is affixed to surface of the die plate 22 by adhesive.

Figure 3:
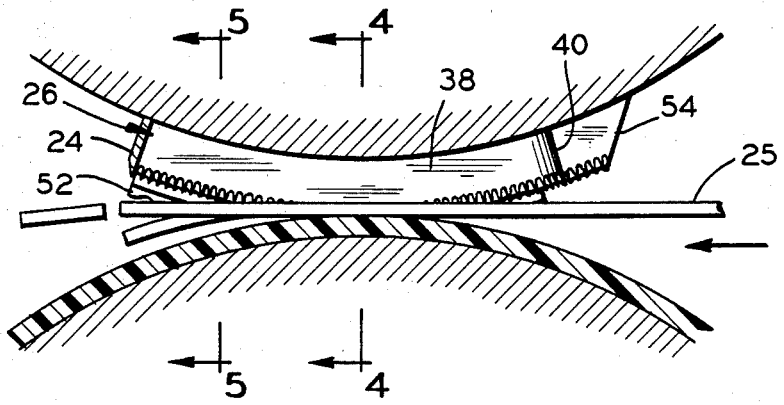
FIG. 3 is a further enlarged, fragmentary view in transverse cross section taken through the nip of an upper die cylinder and a lower back-up cylinder of the machine in FIG. 1, when in operation.

In the operation of the cutting die machine 10, it is assumed that the upper die cylinder 12 is rotating clockwise, as viewed in FIG. 3, and that the lower back-up cylinder 14 is rotating counterclockwise. The corrugated board or other sheet material 25 is fed between the cylinders from right to left with the flutes of the board extending in the direction of feed. The lower, horizontal cutting rule 24 of FIG. 2 cuts the forward portion of the corrugated board to form a leading edge thereon and the cutting rules 26–30 form slots extending from the leading edge. At the nip of the cylinders, the cutting edges 34 of the cutting rules engage and slightly deform the urethane layer 16 on the back-up cylinder 14, as viewed in FIG. 4, but do not actually cut the layer. At this time, the three ejection members 48, 50, and 52 are pushed back of the cutting edges of the rules. Since the ejection member 48 is incompressible, it deforms transversely as it is pushed back. Since the cellular ejection member 50 is compressible, it can accommodate the transverse displacement of the ejection member 48 as well as be compressed toward the die plate 22. Similarly, the outer ejection member 52 is compressed toward the die plate.

Beyond the nip of the cylinders 12 and 14, the three ejection members return to their normal state. In doing so, the ejection member 48, being harder and usually higher than the ejection member 50, pushes the narrow, compressed slot scrap 44 downwardly with a greater force and for a longer time than the softer ejection member 50. This causes the slot scrap 44 to assume a slanted position relative to the original plane of the corrugated board entering the nip of the cylinders. At the same time, the outer ejection member 52, being higher than the member 50, momentarily deflects the portion of the corrugated board 25 adjacent the cutting rule portion 38 downwardly relative to the original plane of the corrugated board 25 and below the undeflected portion of the corrugated board adjacent the cutting rule portion 36. The ejection member 52 also deflects the portion of the corrugated board downwardly to a greater extent than the slot scrap 44 since the ejection member 52 is higher than the ejection member 50. Thus, the ejected slot scrap 44 is momentarily below the slot edge of the corrugated board portion on the other side. The asymmetrical ejection force on the slot scrap 44 thus slants or twists the scrap to more effectively eject it from the corrugated board and, further, the momentary deflection of the corrugated board portion on the one side of the slot by the ejection member 52 further enhances the effectiveness of the ejection of the scrap.

Figure 6:
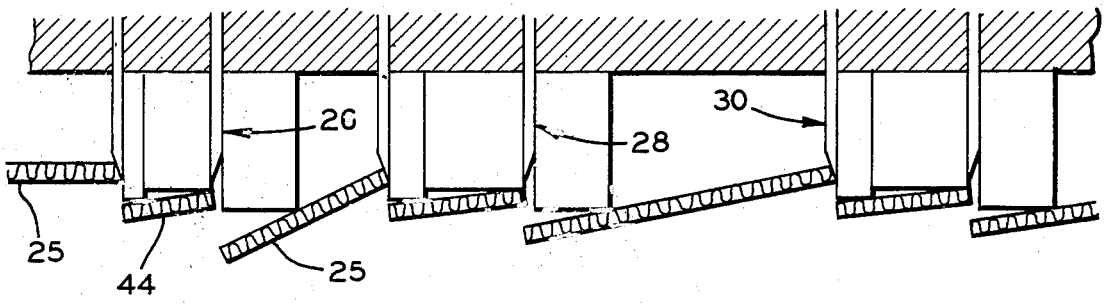
FIG. 6 is a somewhat schematic view in section, similar to FIG. 5 but on a reduced scale, taken through several of the steel cutting rules of FIG. 2, when in operation.

It has also been found that the ejection provisions in accordance with the invention enable slots to be made in corrugated board or other sheet material closer together than heretofore. Thus, referring to FIG. 6, the slots formed by the cutting rules 26 and 28 are relatively close together are compared with the slots formed by the cutting rules 28 and 30 and yet the slot scrap is still effectively ejected and the slots are formed cleanly. Thus, the ejection provisions not only enable narrower slots to be formed with the slot scrap fully ejected and separated, but the slots thermselves can be formed in the corrugated board closer than heretofore with much less difficulty in the scrap ejection.

Figure 7:
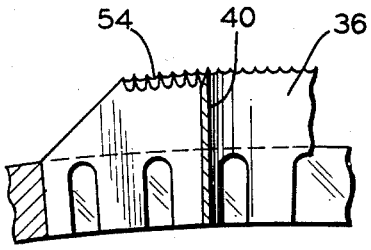
FIG. 7 is a sectional view taken through a portion of the steel rule cutting die of FIG. 2.

Particularly with narrower slots, as the end portions of the slots are formed, the portion of the corrugated board on one side of the slot cannot be deflected as much relative to that on the opposite side by the outer ejection member 52 since the corrugated board portions are joined beyond the slot end. Consequently, there is some tendency for the slot scrap at the end of the slot not to be ejected cleanly in the case of the narrow slots. To overcome this, an additional, short straight cutting rule 54 (FIGS. 2 and 7) can extend symmetrically from the curved end of the cutting rules 26. The straight cutting rule 54 thus cuts a slit in the corrugated board at the end of the slot. This slit enables the corrugated board portion on the one side of the slot to be deflected more at the end of the slot relative to the corrugated board portion on the opposite side and thus facilitates deflecting the one corrugated portion momentarily relative to the other and facilitates ejection of the slot scrap.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. In a cutting die, a die plate, a first cutting rule portion extending upwardly from said die plate and having a first cutting edge spaced a uniform distance above said die plate over the length of said cutting rule portion, a second cutting rule portion extending upwardly from said die plate, having a second cutting edge spaced a uniform distance above said die plate over the length of said second cutting rule portion, and spaced from said first cutting rule portion, a first resilient ejection strip between said cutting rule portions, located adjacent said first cutting rule portion, and extending upwardly at least to the height of the first cutting edge, and a second resilient ejection strip between said cutting rule portions, located adjacent said second cutting rule portion, and extending upwardly to a height not exceeding the height of said first ejection strip, said second ejection strip being softer than said first ejection strip to apply an asymmetrical ejection force to material between said first and said second cutting rule portions.

2. A cutting die according to claim 1 characterized by there being a third ejection strip adjacent said second cutting rule portion on the side opposite said second ejection strip.

3. A cutting die according to claim 2 characterized by said third ejection strip having a height exceeding that of said second ejection strip.

4. A cutting die according to claim 1 characterized by said first resilient ejection strip extending upwardly beyond the height of the first cutting edge and said second resilient ejection strip extending upwardly to a height not exceeding the height of said second cutting edge.

5. A cutting die according to claim 2 characterized by said third ejection member having a height exceeding that of both said first and second ejection strips.

6. A cutting die according to claim 1 characterized by said first and second cutting rule portions being joined by a cutting rule web at ends thereof, and a short, straight cutting rule extending outwardly fom said web in a direction generally parallel to said first and said second cutting rule portions, said short, straight cutting rule being substantially symmetrically spaced with respect to said first and said second cutting rule portions.

7. In a cutting die, a die plate, a first cutting rule portion extending upwardly from said die plate and having a first cutting edge spaced a uniform distance above said die plate along the length of said cutting rule portion, a second cutting rule portion extending upwardly from said die plate and having a second cutting edge spaced a uniform distance above said die plate along the length of said second cutting rule portion, said cutting edges being spaced apart and said cutting rule portions being joined at common ends to form an elongate opening in sheet material, resilient strip means which is harder near said first cutting rule portion than near said second cutting rule portion located between said cutting rule portions for applying an asymmetrical force to slot scrap from the sheet material to eject the scrap away from the die plate, with a portion of the scrap adjacent said first cutting rule portion being ejected farther from the die plate than a portion of the scrap adjacent said second cutting rule portion, and means outside said second cutting rule portion on the side opposite said resilient strip means for pushing a portion of the sheet material located outside said second cutting rule portion farther from said die plate than a portion of the sheet material located outside said first cutting rule portion.

8. A cutting die according to claim 7 characterized by said means outside said second cutting rule portion having a height exceeding that of said resilient strip means.

9. Apparatus for making an elongate opening in a carton blank or the like made from sheet material and for ejecting a scrap strip from the elongate opening, said apparatus comprising first and second arcuate cutting rule means for incrementally cutting the sheet material along spaced apart lines and leaving a narrow scrap strip of sheet material between the lines, resilient ejecting means located between said arcuate cutting rule means for separating the strip from the sheet material by applying a greater force along the narrow strip adjacent one of the lines than along the narrow strip adjacent the other of the lines to cause said strip to twist relative to the plane of the sheet material, said ejecting means comprising a first resilient strip located adjacent the inner surface of one of said cutting rule means, and a second resilient strip located adjacent the inner surface of the other of said cutting rule means, and deflecting means on one side of said cutting rule means for deflecting sheet material away from the plane of the sheet material on the other side of said cutting rule means.

10. Apparatus according to claim 9 characterized by said first resilient strip being higher than said second resilient strip.

11. Apparatus according to claim 10 characterized by said second resilient strip being softer than said first resilient strip.

12. Apparatus for making an elongate opening in a carton blank or the like made from sheet material and for ejecting a scrap strip from the elongate opening, said apparatus comprising first and second arcuate cutting rule means for incrementally cutting the sheet material along spaced apart lines and leaving a narrow scrap strip of sheet material between the lines, resilient ejecting means located between said arcuate cutting rule means for separating the strip from the sheet material by applying a greater force along the narrow strip adjacent one of the lines than along the narrow strip adjacent the other of the lines to cause said strip to twist relative to the plane of the sheet material, and deflecting means on one side of said cutting rule means for deflecting sheet material away from the plane of the sheet material on the other side of said cutting rule means, said first and second arcuate cutting rule portions being joined at common ends by a cutting rule web to form an end of said elongate opening, and a third cutting rule portion extending outwardly from said web and parallel to said first and said second arcuate cutting rule portions for forming a slit in the elongate opening beyond the end.

13. In a cutting die, a die plate, a first cutting rule portion extending upwardly from said die plate and having a first cutting edge spaced a uniform distance above said die plate along the length of said cutting rule portion, a second cutting rule portion extending upwardly from said die plate and having a second cutting edge spaced a uniform distance above said die plate along the length of said second cutting rule portion, said cutting edges being spaced apart and said cutting rule portions being joined at common ends to form an elongate opening in sheet material, resilient strip means which is higher near said first cutting rule portion than near said second cutting rule portion and is harder near said first cutting rule portion than near said second cutting rule portion, said resilient strip means being located between said cutting rule portions for applying an asymmetrical force to slot scrap from the sheet material to eject the scrap away from the die plate, with a portion of the scrap adjacent said first cutting rule portion being ejected farther from the die plate than a portion of the scrap adjacent said second cutting rule portion, and means outside said second cutting rule portion on the side opposite said resilient strip means for pushing a portion of the sheet material located outside said second cutting rule portion farther from said die plate than a portion of the sheet material located outside said first cutting rule portion.

14. A cutting die according to claim 13 characterized by said means outside said second cutting rule portion having a height exceeding that of said resilient strip means.

15. In a cutting die, a die plate, a first cutting rule portion extending upwardly from said die plate and having a first cutting edge spaced a uniform distance above said die plate along the length of said cutting rule portion, a second cutting rule portion extending upwardly from said die plate and having a second cutting edge spaced a uniform distance above said die plate along the length of said second cutting rule portion, said cutting edges being spaced apart and said cutting rule portions being joined at common ends to form an elongate opening in sheet material, ejecting means located between said cutting rule portions for applying an asymmetrical force to slot scrap from the sheet material to eject the scrap away from the die plate, with a portion of the scrap adjacent said first cutting rule portion being ejected farther from the die plate than a portion of the scrap adjacent said second cutting rule portion, and means outside said second cutting rule portion on the side opposite said ejecting means for pushing a portion of the sheet material located outside said second cutting rule portion farther from said die plate than a portion of the sheet material located outside said first cutting rule portion, said first and second cutting rule portions being joined at common ends by an arcuate cutting rule web, and a third cutting rule extending outwardly from said cutting rule web and having a third cutting edge spaced a uniform distance above said die plate and parallel to said first and second cutting rule edges to form a slit in the sheet material beyond the end of the slot.

16. A method of making an elongate opening in a carton blank or the like made from sheet material and ejecting a scrap strip from the elongate opening, said method comprising incrementally cutting the sheet material along substantially parallel lines, leaving a narrow scrap strip of sheet material between the lines, separating the strip from the sheet material by applying a greater force for a longer time along the narrow strip adjacent one of the cutting lines than along the strip adjacent the other of the cutting lines to cause said strip to twist relative to the remaining sheet material, and incrementally cutting the sheet material along a straight line beyond an end of the elongate opening.

* * * * *